US008282075B2

(12) United States Patent
Chan

(10) Patent No.: US 8,282,075 B2
(45) Date of Patent: Oct. 9, 2012

(54) ADJUSTABLE CARRIAGE ASSEMBLY

(75) Inventor: Raymond C. Chan, St. Joseph, MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 72 days.

(21) Appl. No.: 12/894,695

(22) Filed: Sep. 30, 2010

(65) Prior Publication Data

US 2011/0073819 A1 Mar. 31, 2011

Related U.S. Application Data

(60) Provisional application No. 61/247,148, filed on Sep. 30, 2009, provisional application No. 61/248,344, filed on Oct. 2, 2009.

(51) Int. Cl.
*B66F 5/00* (2006.01)

(52) U.S. Cl. ..... 254/2 B; 254/1; 254/2 R; 414/426; 29/281.1

(58) Field of Classification Search ..... 254/2 B, 254/2 R, 1; 29/281.1
See application file for complete search history.

(56) References Cited

U.S. PATENT DOCUMENTS

| | | | | |
|---|---|---|---|---|
| 401,368 | A | 4/1889 | Piper | |
| 1,650,031 | A * | 11/1927 | Nash | 414/428 |
| 1,964,119 | A * | 6/1934 | Hendry | 414/427 |
| 2,252,534 | A * | 8/1941 | Trotter | 414/428 |
| 2,388,692 | A * | 11/1945 | House | 280/47.11 |
| 2,962,730 | A * | 12/1960 | Carnes et al. | 5/86.1 |
| 3,999,675 | A | 12/1976 | Forry et al. | |
| 4,342,377 | A | 8/1982 | Goodwin | |
| RE35,907 | E | 9/1998 | Obrecht | |
| 5,911,408 | A * | 6/1999 | Berends et al. | 254/2 B |
| 5,954,160 | A * | 9/1999 | Wells et al. | 187/219 |
| 6,502,878 | B1 | 1/2003 | Peters et al. | |
| 6,701,596 | B2 | 3/2004 | Kloepfer et al. | |
| 7,451,962 | B1 | 11/2008 | Kennedy | |
| 2004/0146384 | A1 * | 7/2004 | Whelan | 414/426 |
| 2006/0182564 | A1 * | 8/2006 | Thiel et al. | 414/427 |
| 2010/0102284 | A1 * | 4/2010 | Drake | 254/1 |

FOREIGN PATENT DOCUMENTS

WO WO98/30488 A1 7/1998

* cited by examiner

*Primary Examiner* — Lee D Wilson
*Assistant Examiner* — Melanie Alexander
(74) *Attorney, Agent, or Firm* — Hovey Williams LLP

(57) ABSTRACT

An adjustable carriage assembly is provided that includes a shaft assembly, a carriage section and a vertical movement section. The carriage section has a centerline and first and second lift pad assemblies operably connected to the shaft assembly. The shaft assembly is configured to translate rotational movement to synchronous movement of the lift pad assemblies. The vertical movement section is connected to the carriage section and is configured to attach to a lift system for raising and lowering the carriage section.

20 Claims, 8 Drawing Sheets

ADJUSTABLE CARRIAGE ASSEMBLY

CROSS-REFERENCE TO RELATED APPLICATIONS

This application claims priority under 35 U.S.C. §119(e) to U.S. provisional patent application Nos. 61/247,148, filed Sep. 30, 2009 and 61/248,344, filed Oct. 2, 2009.

BACKGROUND OF THE INVENTION

1. Field of the Invention

The present invention relates to an adjustable carriage assembly. Specifically, the present invention is for an adjustable carriage assembly for lifting a vehicle tire attached to a vehicle axle.

2. Background Information

For vehicle repair and maintenance, it is often necessary to raise the vehicle above the ground so as to more easily reach parts of the vehicle that are inaccessible when the vehicle is resting on the ground.

One way of lifting a vehicle is by using a lift system stationed at each tire of the vehicle. The lift systems are coordinated through various means to lift the tires of the vehicle at relatively the same time and velocity. Each lift system has a column mechanism and a carriage assembly that is vertically movable along the column mechanism. The carriage assembly grasps the tire with a pair of protrusions to engage securely the tire and the column mechanism lifts the carriage assembly using a hydraulic cylinder, for example.

The pair of protrusions that extend outwardly away from the carriage assembly are spaced apart at a distance less than the diameter of the tire such that, when lifting of the carriage assembly occurs, a portion of the tire is disposed between the protrusions.

Since there are many different vehicle tire diameters, a problem arises in adjusting the carriage assembly such that it may properly grasp the tire. Large fleets that contain many diverse vehicles, such as the military's vehicles, require frequent adjustments of the pair of protrusions. Prior art carriage assemblies require manual adjustment of the protrusions to increase or decrease the space therebetween. The manual adjustment includes, for example, manually lifting and sliding each protrusion and then locking the protrusions into place with a pin, for example. This is time consuming and, when performed inaccurately, can cause the dangerous situation of overloading one side of the carriage assembly.

In view of the above, it will be apparent to those skilled in the art from this disclosure that there exists a need for an improved adjustable carriage assembly. This invention addresses this need in the art as well as other needs, which will become apparent to those skilled in the art from this disclosure.

SUMMARY OF THE INVENTION

It is an object of the present invention to provide an adjustable carriage assembly. It is another object of the invention to provide a carriage assembly that synchronizes lateral movement to keep a load centered and limit side loading.

In order to achieve the above mentioned objects and other objects of the present invention, an adjustable carriage assembly is provided that basically comprises a shaft assembly and a carriage section. The carriage section has a centerline, a first lift pad assembly and a second lift pad assembly. The first lift pad assembly and the second lift pad assembly are operably connected to the shaft assembly on respective sides of the centerline. The shaft assembly is configured to translate rotational movement to synchronous movement of the lift pad assemblies.

A lift system for lifting a vehicle tire attached to a vehicle axle is provided that basically comprises a carriage assembly, a column mechanism and a base member. The carriage assembly includes a shaft assembly and a carriage section. The carriage section has a centerline, a first lift pad assembly and a second lift pad assembly. The first lift pad assembly and the second lift pad assembly are operably connected to the shaft assembly on respective sides of the centerline. The shaft assembly is configured to translate rotational movement to synchronous movement of the lift pad assemblies. The column mechanism is slideably coupled to the carriage assembly. The base member is attached to a bottom portion of the column mechanism. The base member includes lateral support members for providing forward support for the column mechanism and the carriage assembly.

A method of lifting a vehicle tire attached to a vehicle axle using a column mechanism slideably coupled to a carriage assembly having first and second lift pad assemblies is provided that basically comprises synchronously moving the first and second lift pad assemblies towards a center of the carriage assembly; engaging the vehicle tire at a first side of a circumference of the vehicle tire with the first lift pad assembly; engaging the vehicle tire at a second side of a circumference of the vehicle tire with the second lift pad assembly; and substantially centering the vehicle tire with respect to the carriage assembly.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings that form a part of this original disclosure.

DETAILED DESCRIPTION

A preferred embodiment of the present invention will now be explained with reference to the drawings. It will be apparent to those skilled in the art from this disclosure that the following description of the embodiment of the present invention is provided for illustration only and not for the purpose of limiting the invention.

Referring initially to FIGS. 1A-1D, an adjustable carriage assembly 1 disposed in a lift system 2 is shown. The lift system 2 is preferably a portable lift system and more preferably, a wireless portable lift system. The lift system 2 has a column mechanism 3 and is configured to lift a vehicle tire while attached to the vehicle.

Figure 2B:
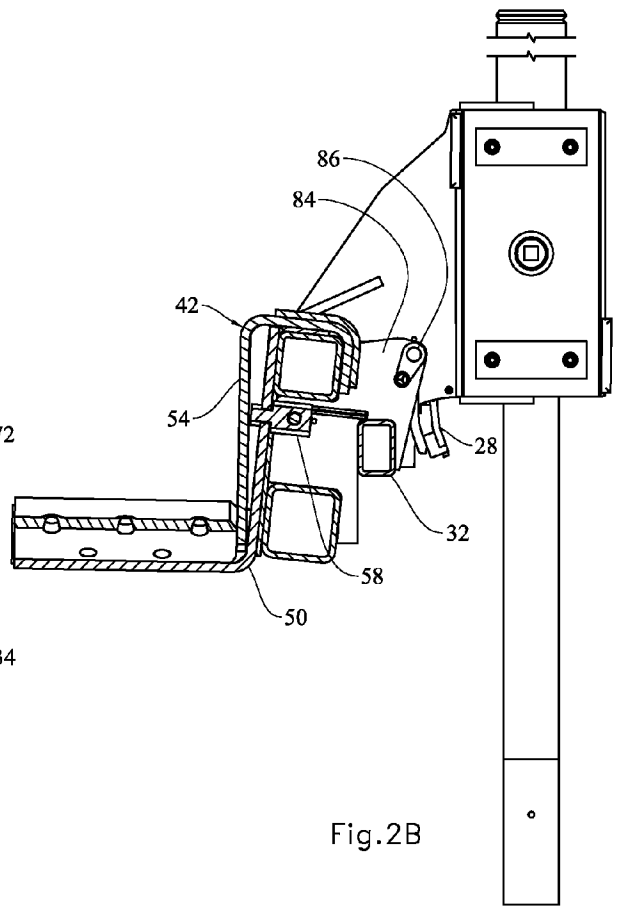
FIG. 2B is a partial cross-sectional view taken along lines A-A in FIG. 2A.
Figure 2A:
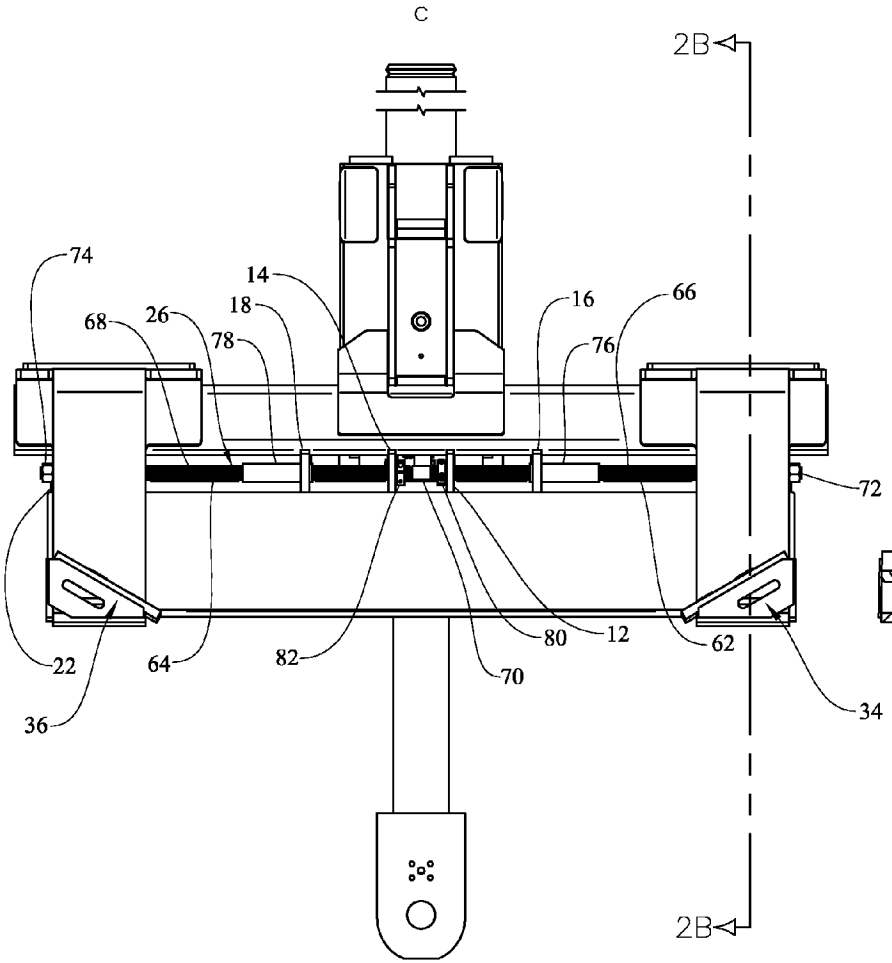
FIG. 2A is a front elevation view of the carriage assembly shown in FIGS. 1A-1D according to the embodiment of the present invention.
Figure 2D:
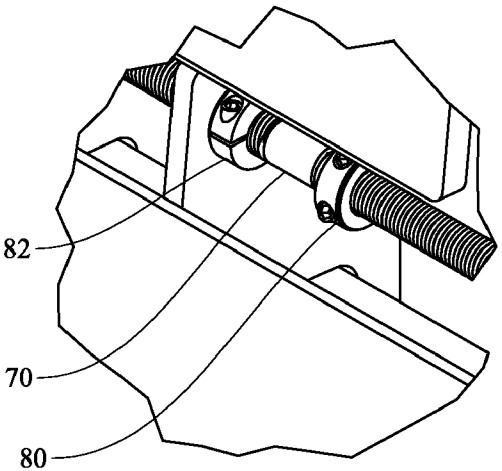
FIG. 2D is an enlarged perspective view taken at location D in FIG. 2C with some parts being removed from the view in FIG. 2D for clarity.
Figure 2C:
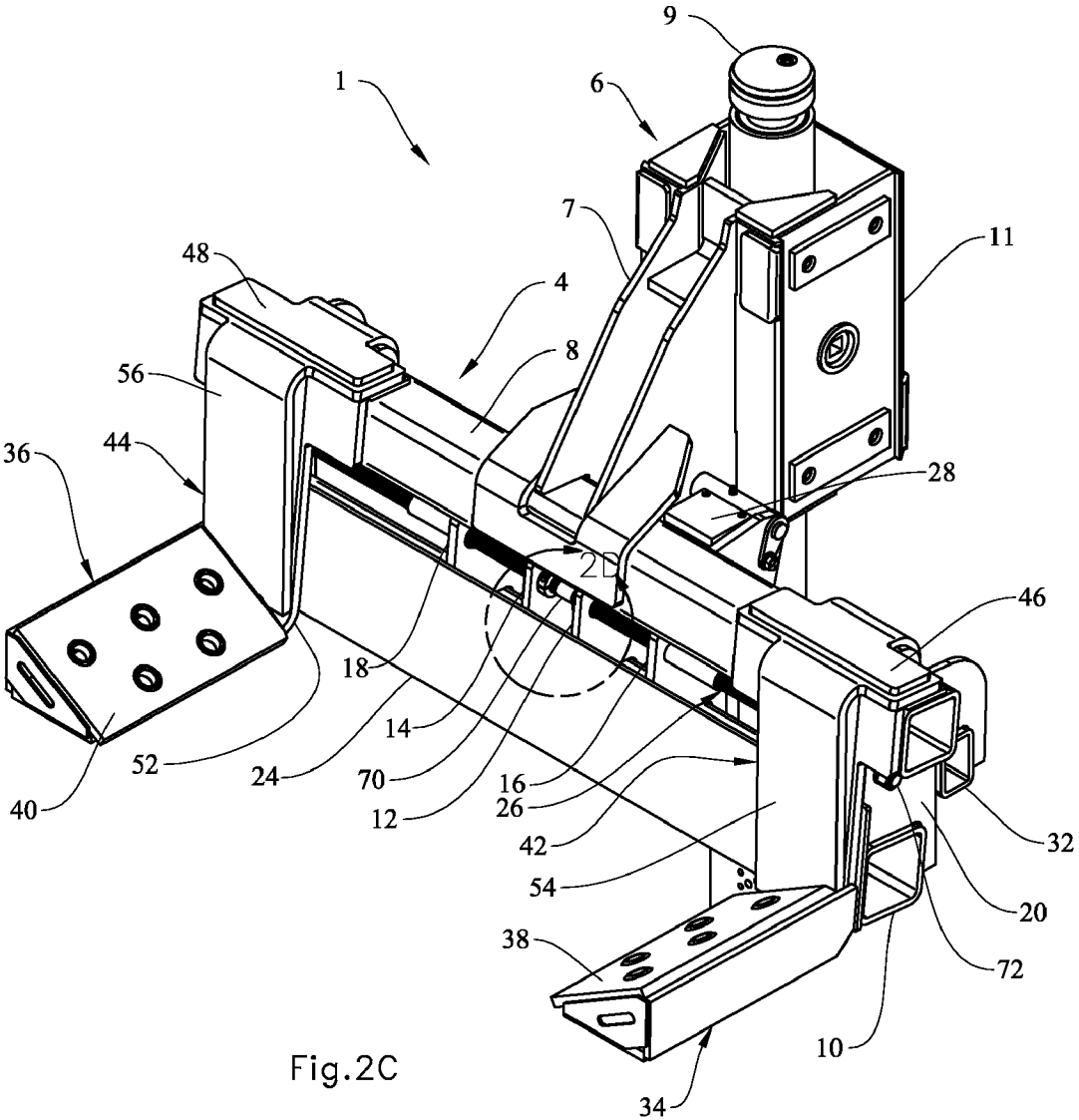
FIG. 2C is a front perspective view of the carriage assembly according to the embodiment of the present invention.
Figure 3B:
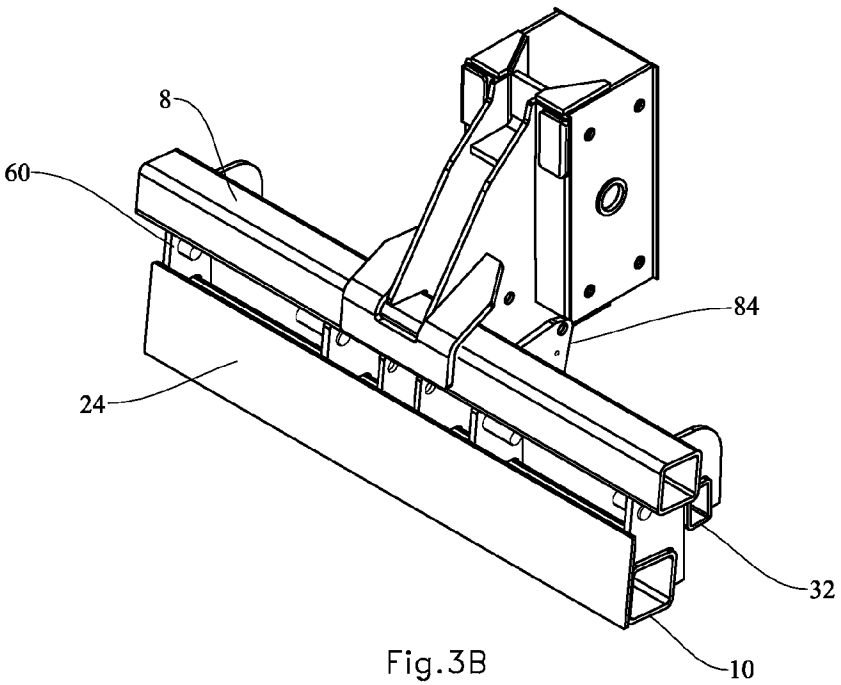
FIG. 3B is a front perspective view of the carriage assembly without first and second lift pad assemblies.
Figure 3A:
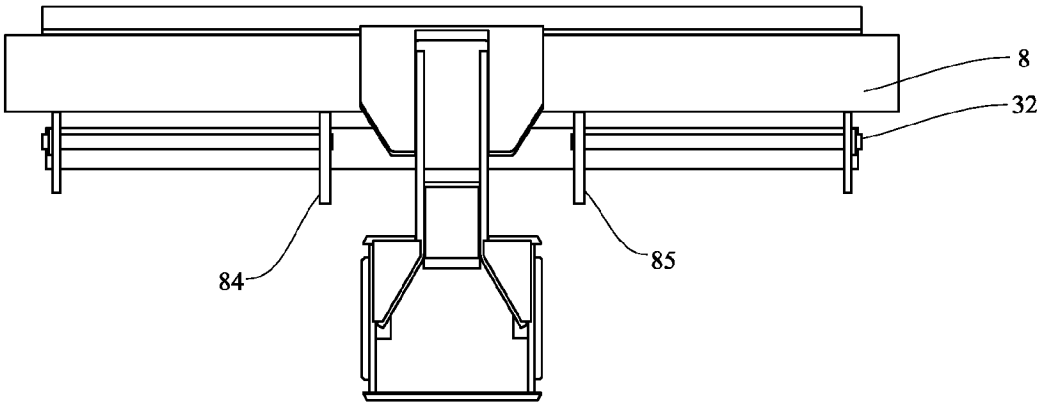
FIG. 3A is a top plan view of the carriage assembly without first and second lift pad assemblies.
Figures 4A, 4B:
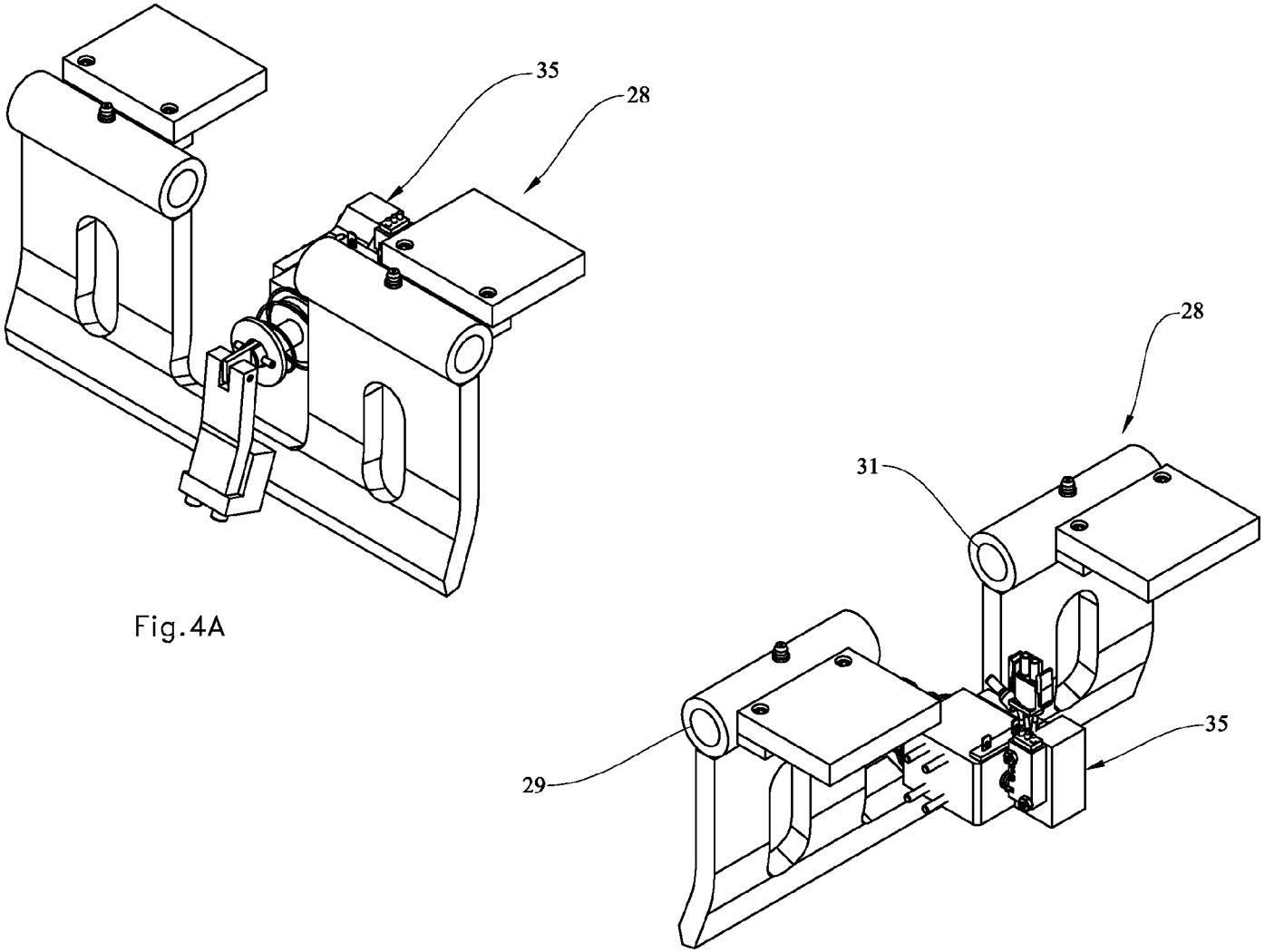
FIG. 4A is a front perspective view of a stop assembly according to the embodiment of the present invention.
FIG. 4B is a rear perspective view of the stop assembly according to the embodiment of the present invention.

The adjustable carriage assembly 1 includes a carriage section 4 and a vertical movement section 6 connected to the carriage section 4, shown in FIG. 2C. As will be explained in more detail below, the carriage section 4 has a construction that facilitates horizontal movement to adjust to the size of a vehicle tire and the vertical movement section 6 is configured for vertical movement to lift the vehicle tire.

The carriage section 4 includes a top rail 8, a bottom rail 10, a first inner plate 12, a second inner plate 14, a first outer plate 16, and a second outer plate 18. The top and bottom rails 8, 10 run generally parallel to each other and are both generally perpendicular to the vertical movement section 6. In the embodiment shown, the top and bottom rails 8, 10 are hollow to decrease weight. The inner plates 12, 14 and outer plates 16, 18 are immovably disposed between the top and bottom rails 8, 10 in a spaced-apart configuration.

The vertical movement section 6 includes a connecting arm 7 that connects the carriage section 4 to the vertical movement section 6, a hydraulic cylinder 9 and a housing 11. Referring to FIG. 2C, the connecting arm 7 attaches to the top rail 8 and extends upwardly to the housing 11 where it connects with the housing 11. The housing 11 surrounds the hydraulic cylinder 9 and fits into the lift system 2 as shown in FIGS. 1A-1D. The vertical movement section 6 operates with the lift system 2 to lift and lower the carriage section 4 as is known in the art. In particular, the vertical movement section 6 is slidably coupled to the column mechanism 3 of the lift system 2.

The carriage section 4 further includes a first side guard plate 20 disposed at a first end of the top and bottom rails 8, 10 and a second side guard plate 22 disposed at a second end of the top and bottom rails 8, 10 and a front guard plate 24. The first and second side guard plates 20, 22 are secured to at least the bottom rail 10 via, for example, welding, press fitting, etc. Along the front of the bottom rail 10, the front guard plate 24 is disposed. The front guard plate 24 runs along the same length as the bottom rail 10, but the width is greater such that the front guard plate 24 extends past the bottom rail 10 toward the top rail 8. The top rail 8, bottom rail 10, first and second side guard plates 20, 22 and front guard plate 24 outline and protect an area for a movement synchronizer, which is detailed below.

The carriage section 4 further includes a downstop assembly 28 disposed on a back side of the top rail 8. The downstop assembly 28 pivots on downstop rod 86 bolted to connecting arm 7 by a maneuvering device 35. Specifically, referring to FIG. 3A, a first brace 84 and a second brace 85 connect the top rail 8, bottom rail 10 and rear rail 32, which is located to the rear of the top and bottom rails 8, 10. The first and second braces 84, 85 support the downstop assembly 28 and a downstop rod 86 holds the downstop assembly 28 between the first and second braces 84, 85. Referring to FIGS. 3A-3B and 4A-4C, the braces 84, 85 are disposed on respective sides of the centerline. First and second hollow tubes 29, 31 are aligned with apertures on the braces 84, 85 and the connecting arm 7. The downstop rod 86 is secured through the apertures and through the hollow tubes 29, 31. Referring to FIGS. 1A-1D, the downstop assembly 28 interacts with a plurality of stops 33 on the lift system 2. Specifically, the maneuvering device 35 is mounted to connecting arm 7 and is used to pivot the downstop assembly 28 about the downstop rod 86 and thereby engage or disengage the stops 33.

Figure 1B:
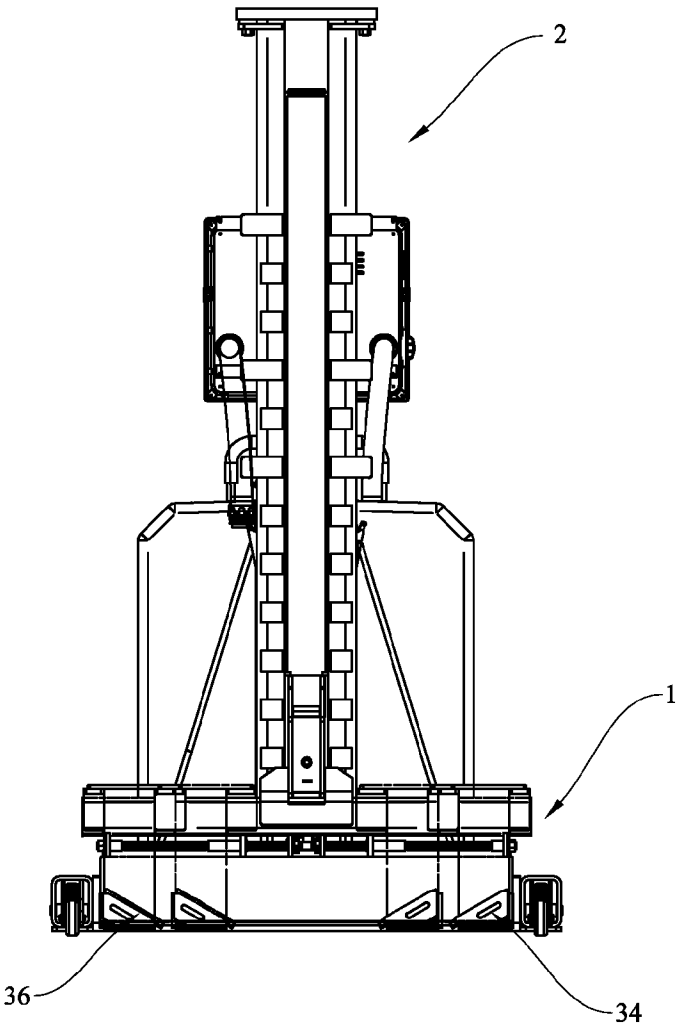
FIG. 1B is front elevation view of the lift system and the carriage assembly according to the embodiment of the present invention.

In order to allow an operator to make simple adjustments to the carriage assembly 1, the carriage assembly 1 has a movement synchronizer, a first lift pad assembly 34 and a second lift pad assembly 36 that are laterally movable by the movement synchronizer. The movement synchronizer can include a rack and pinion, four bar linkage or hydraulics, for example. In the embodiment shown, the movement synchronizer includes a shaft assembly 26 that is operably connected to the first and second lift pad assemblies 34, 36 and moves the first and second lift pad assemblies 34, 36 laterally by translating rotational movement into lateral movement. The lateral movement is synchronous. That is, as illustrated in FIG. 1B, the first and second lift pad assemblies 34, 36 move the same distance toward or away from each other at the same time. This advantageously reduces the risk of side loading, i.e. overloading one of the lift pad assemblies 34, 36, which is undesirable in the use of the lift system 2.

The first lift pad assembly 34 includes a first lift pad 38 that slopes downwardly toward a centerline C of the carriage assembly 1. In a mirror image of the first lift pad 38, the second lift pad assembly 36 includes a second lift pad 40 that slopes downwardly toward the centerline C of the carriage assembly 1. Tread, such as protrusions or the like, is provided on an exterior surface of the pads 38, 40 to aid in gripping the vehicle tire. The first and second lift pad assemblies 34, 36 each include a respective connecting arm 42, 44 and reinforcing plate 46, 48. The connecting arms 42, 44 extend upwardly from the lift pads 38, 40, respectively, and wrap around the top rail 8. Each of the connecting arms 42, 44 comprises a respective interior plate 50, 52 and exterior plate 54, 56. The interior plates 50, 52 support the under side of the lift pads 38, 40, respectively, and the exterior plates 54, 56 extend toward and wrap around the top rail 8. The reinforcing plates 46, 48 are disposed on top of the interior plate 50. The first lift pad assembly 34 and the second lift pad assembly 36 are connected to the shaft assembly 26 via first and second threaded blocks 58, 60, respectively. Specifically, the first and second threaded blocks 58, 60 are connected to the interior plates 50, 52 respectively.

The carriage assembly 1 allows an operator to simply adjust both lift pads 34, 36 from either side of the carriage section 4. This is facilitated by cutting or rolling right and left hand threads onto the shaft assembly 26. Specifically, in the embodiment illustrated, the shaft assembly 26 includes a first shaft 62 having left hand threads 66 and a second shaft 64 having right hand threads 68. Also included in the shaft assembly 26 is a coupler 70, which non-rotatably couples together the first shaft 62 and the second shaft 64. While two shafts 62, 64 coupled together are used in this embodiment, it will be apparent to one of ordinary skill in the art from this disclosure that the two shafts 62, 64 can be a one-piece unitary member with left hand threads rolled or cut onto one end and right hand threads rolled or cut onto the other end.

The first shaft 62 extends through an aperture in the first inner plate 12 and through an aperture in the first outer plate 16. An end portion of the first shaft 62 extends through an aperture in the first side guard plate 20. The end portion of the first shaft 62 has a first leverage component 72 immovably fixed thereon. The first leverage component 72 is formed to allow a tool that creates leverage to easily attach and subsequently rotate the first shaft 62. That is, the first leverage component 72 is non-rotatably fixed on the first shaft 62. The first leverage component 72 preferably includes a plurality of wrench flats. Similarly, the second shaft 64 extends through an aperture in the second inner plate 14 and through an aperture in the second outer plate 18. An end portion of the second shaft 64 extends through an aperture in the second side guard plate 22. The end portion of the second shaft 64 has a second leverage component 74 immovably fixed thereon. The second leverage component 74 is formed to allow a tool that creates leverage to easily attach and subsequently rotate the second shaft 64. That is, the second leverage component 74 is non-rotatably fixed on the second shaft 64. The second leverage component 74 preferably includes a plurality of wrench flats.

The left hand threads 66 and the right hand threads 68 are preferably ACME threads. That is, the left hand threads 66 and the right hand threads 68 are threads for a lead screw (translation screw or power screw). These threads 66, 68 aid in translating radial motion into linear motion. The construction of the threads 66, 68 provides a self-locking feature. In other words, the threads 66, 68, engaged with the respective threaded block 58, 60, lock the lift pad assemblies 34, 36 into place until the shaft assembly 26 is rotated.

To ensure that the shaft assembly 26 is properly positioned, a first collar 80 and a second collar 82 are provided. The first collar 80 is positioned in a groove on the first shaft 62 and the second collar 82 is position in a groove on the second shaft 64. Thus, the first collar 80 is immovable relative to the first shaft 62 and the second collar 82 is immovable relative to the second shaft 64. The first and second collars 80, 82 are positioned between the first and second inner plates 12, 14 and thereby lock the shafts 62, 64 within the carriage section 4.

In operation, an operator attaches a wrench or a spanner to one of the first and second leverage components 72, 74 and rotates the shaft assembly 26. The first shaft 62, which is threaded through threaded block 58, and the second shaft 64, which is threaded through the threaded block 60, cause the lift pad assemblies 34, 36 to move linearly and synchronously towards or away from the centerline of the carriage assembly 1, depending on the direction of rotation by the operator. A first stopper 76 disposed on a side of the first outer plate 16 and a second stopper 78 disposed on a side of the second outer plate 18 serve to limit the amount of linear movement by their respective lift pad assemblies 34, 36.

Thus, the lift pad assemblies 34, 36 synchronously adjust towards or away from the centerline C of the carriage assembly 1. This provides a range of motion to accommodate various vehicle tire diameters. In the embodiment shown, vehicle tire diameters from 24 to 53 inches can be accommodated. However, smaller or larger diameters are within the scope of the invention. Furthermore, the synchronous adjustment limits the possibility of side loading the carriage assembly 1 by substantially centering the tire with respect to the carriage assembly 1. Additionally, the present invention is most advantageous because the lift pad assemblies 34, 36 can be adjusted to accommodate various vehicle tire diameters from only one side of the carriage assembly 1. In operation, a tire attached to a vehicle axle is lifted using the column mechanism 3 and the carriage assembly 1. The first and second lift pad assemblies 34, 36 are synchronously moved towards the centerline C of the carriage assembly 1. The vehicle tire is engaged at a first side of a circumference of the vehicle tire with the first lift pad assembly 34 and the vehicle tire is engaged at a second side of the circumference of the vehicle tire with the second lift pad assembly 36. The engaging with the first and second lift pad assemblies can occur substantially simultaneously depending on the location of the vehicle tire when the synchronous movement of the lift pad assemblies 34, 36 begins. The vehicle tire is then substantially centered with respect to the carriage assembly 1 using the lift pad assemblies 34, 36.

Figure 1A:
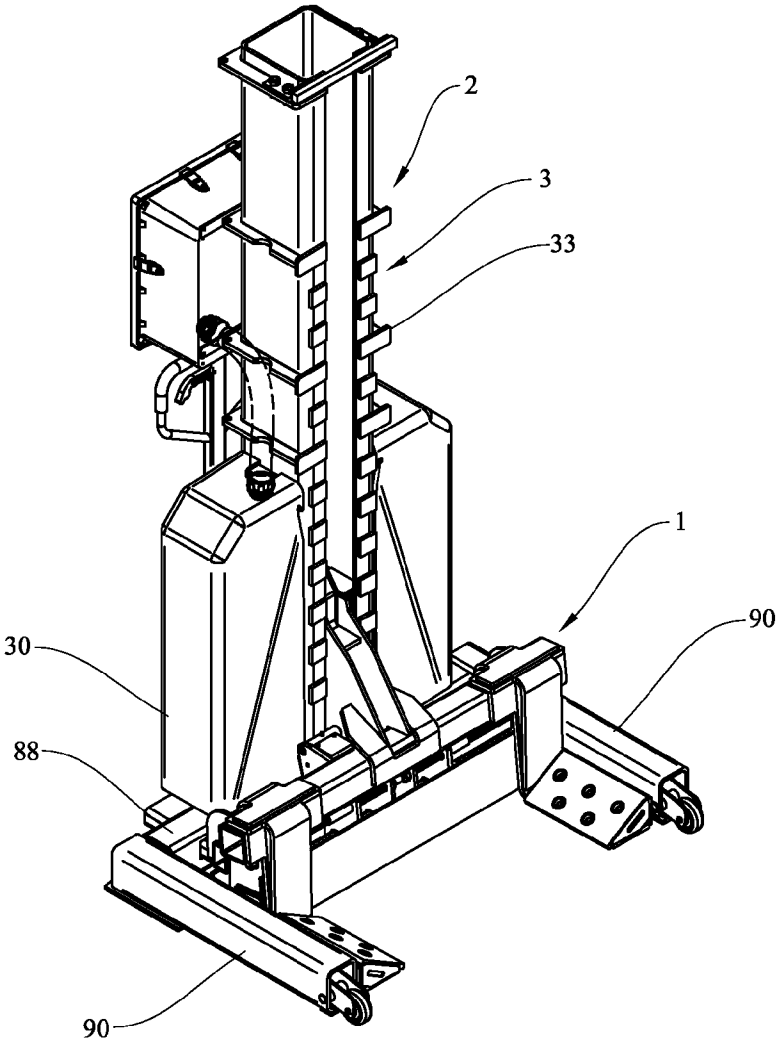
FIG. 1A is a front perspective view of a lift system and a carriage assembly according to an embodiment of the present invention.
Figure 1D:
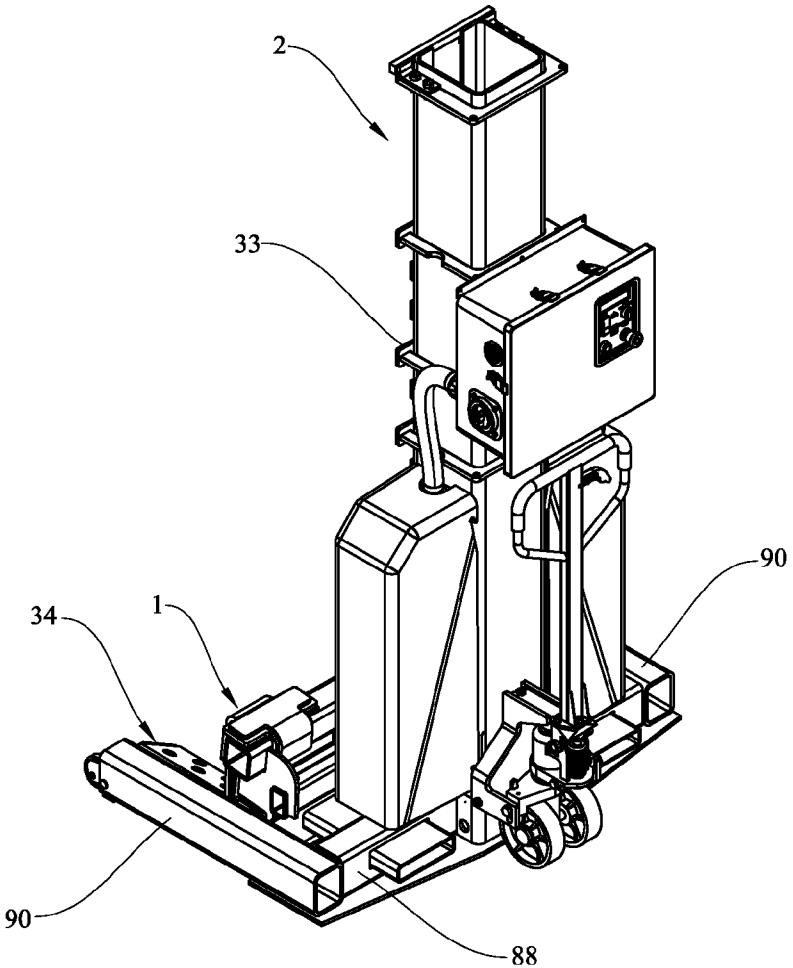
FIG. 1D is a rear perspective view of the lift system and the carriage assembly according to the embodiment of the present invention.
Figure 1C:
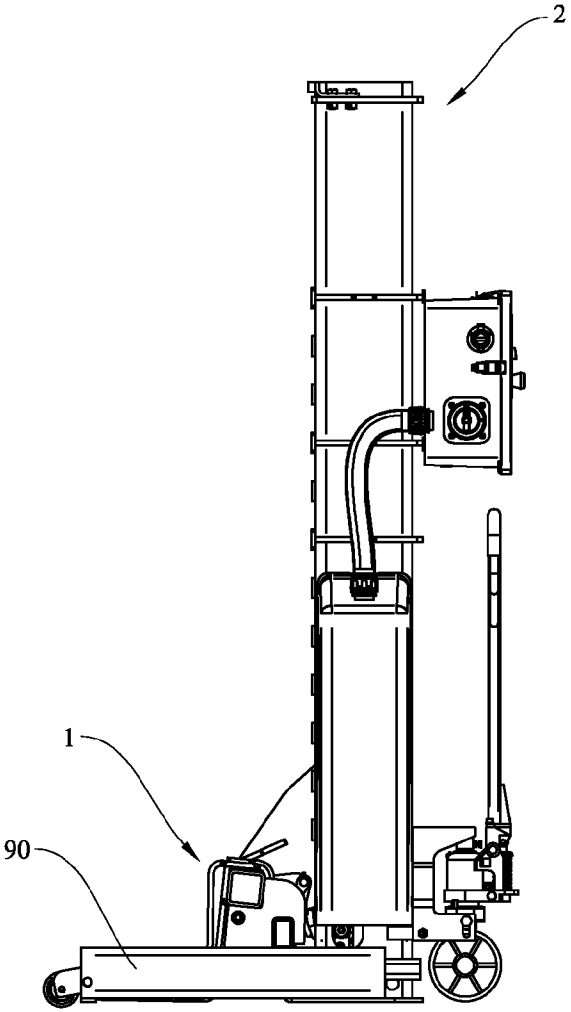
FIG. 1C is a first side elevation view the lift system and the carriage assembly according to the embodiment of the present invention.

The column mechanism 3 has a base member 88 attached at a bottom portion of the column mechanism 3. The base member 88 includes lateral support members 90 extending away from the column mechanism 3 and preferably extending forwardly to provide forward support for the carriage assembly 1 and lift system 2. As illustrated in FIG. 1A, when the carriage assembly 4 is lowered proximal to the ground, the lift pad assemblies 34, 36 are adjacent the lateral support members 90. Thus, in operation, when the lift pad assemblies 34, 36 are engaging respective sides of a vehicle tire, the lateral support members 90 reach underneath the vehicle such that the vehicle tire is located between the lateral support members 90.

Figure 5B:
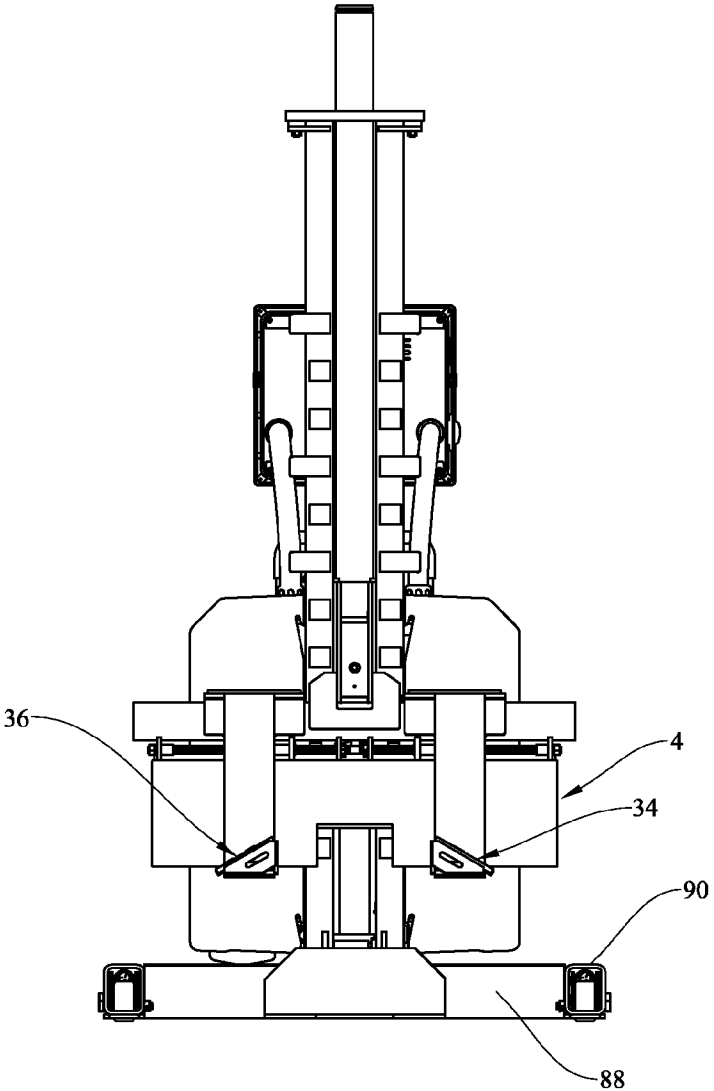
FIG. 5*b* is a front elevation view of a lift system (2) and carriage assembly (1) according to an embodiment of the present invention where the tire-engaging lift pads (34, 36) slope downwardly away from the centerline of the carriage assembly (1)
Figure 5A:
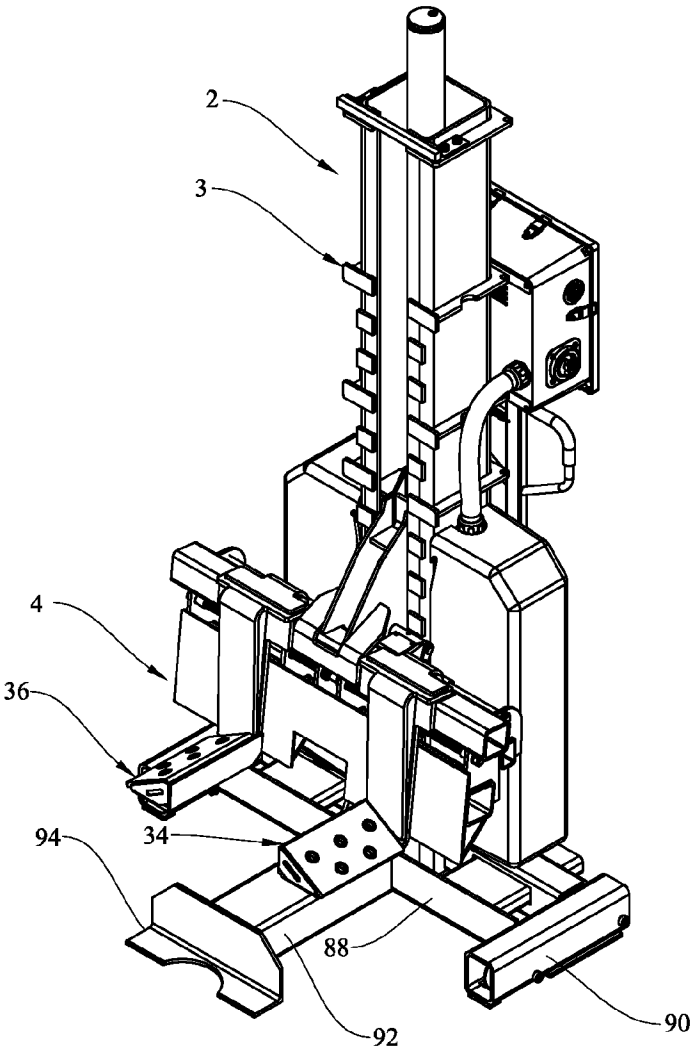
FIG. 5*a* is a front perspective view of a lift system (2) and carriage assembly (1) according to an embodiment of the present invention where the tire-engaging lift pads (34, 36) slope downwardly away from the centerline of the carriage assembly (1)
Figure 5D:
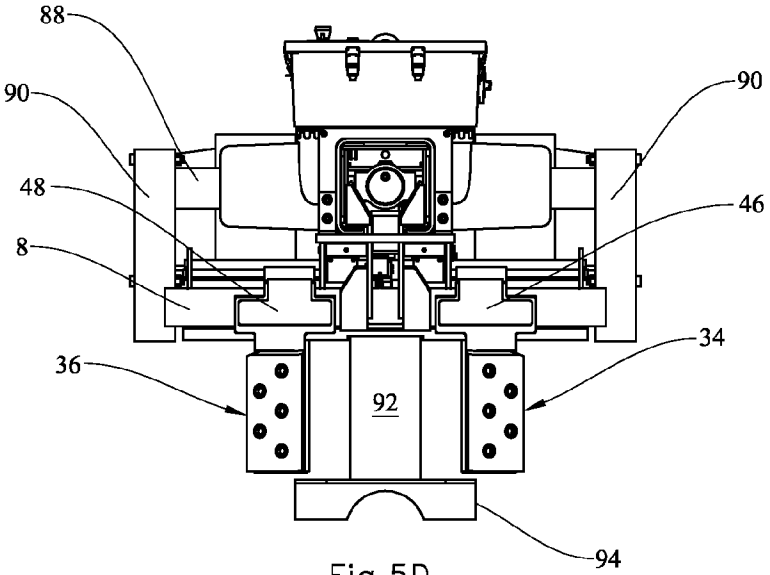
FIG. 5*d* is a top plan view of a lift system (2) and carriage assembly (1) according to an embodiment of the present invention where the tire-engaging lift pads (34, 36) slope downwardly away from the centerline of the carriage assembly (1).
Figure 5C:
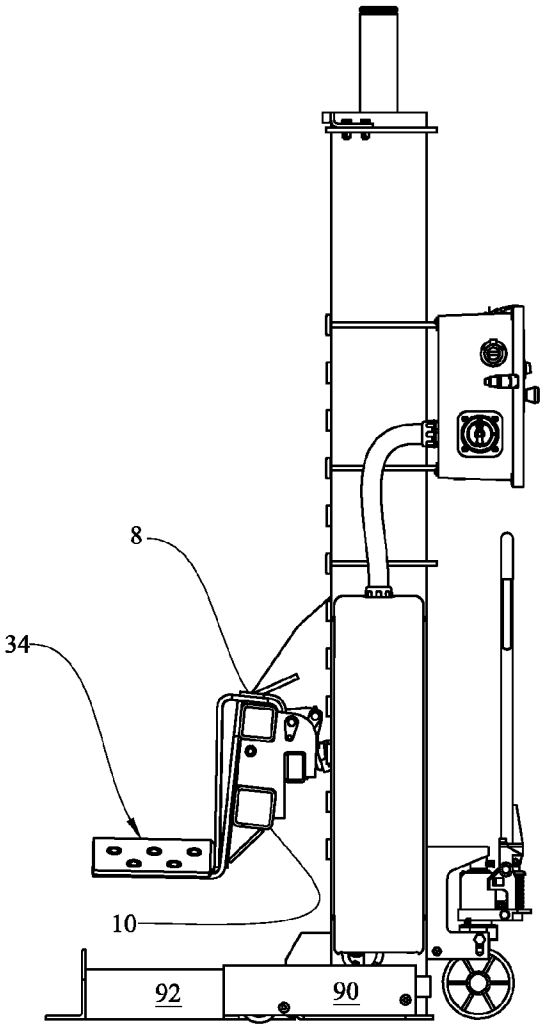
FIG. 5*c* is a side elevation view of a lift system (2) and carriage assembly (1) according to an embodiment of the present invention where the tire-engaging lift pads (34, 36) slope downwardly away from the centerline of the carriage assembly (1)

FIG. 5*a* is a front perspective view of a lift system (2) and carriage assembly (1) according to an embodiment of the present invention where the tire-engaging lift pads (34, 36) slope downwardly away from the centerline of the carriage assembly (1); FIG. 5*b* is a front elevation view of a lift system (2) and carriage assembly (1) according to an embodiment of the present invention where the tire-engaging lift pads (34, 36) slope downwardly away from the centerline of the carriage assembly (1); FIG. 5*c* is a side elevation view of a lift system (2) and carriage assembly (1) according to an embodiment of the present invention where the tire-engaging lift pads (34, 36) slope downwardly away from the centerline of the carriage assembly (1); and FIG. 5*d* is a top plan view of a lift system (2) and carriage assembly (1) according to an embodiment of the present invention where the tire-engaging lift pads (34, 36) slope downwardly away from the centerline of the carriage assembly (1).

In understanding the scope of the present invention, the term "comprising" and its derivatives, as used herein, are intended to be open ended terms that specify the presence of the stated features, elements, components, groups, and/or steps, but do not exclude the presence of other unstated features, elements, components, groups, and/or steps. The foregoing also applies to words having similar meanings such as the terms, "including", "having" and their derivatives. The terms of degree such as "substantially", "about" and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

It will be apparent to those skilled in the art from this disclosure that various changes and modifications can be made herein without departing from the scope of the invention. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention.

The invention claimed is:

1. A lift system for lifting a vehicle tire attached to a vehicle axle comprising:

a carriage assembly including a shaft assembly and a carriage section, the carriage section having a centerline, a top rail, a bottom rail, a connecting member, a first lift pad assembly and a second lift pad assembly, the top and bottom rails extending generally parallel to each other, the connecting member rigidly coupling the top and bottom rails to one another and defining an opening, the first and second lift pad assemblies being cooperatively supported by and shiftable relative to the top and bottom rails, the first lift pad assembly and the second lift pad assembly being operably connected to the shaft assembly on respective sides of the centerline, the shaft assembly comprising a threaded shaft and a leverage component, the threaded shaft extending through the opening in the connecting member, the leverage component presenting a polygonal outer surface to which a wrench can be attached, the shaft assembly being configured to translate rotational movement of the leverage component to synchronous movement of the lift pad assemblies;

a column mechanism slideably coupled to the carriage assembly; and a base member attached to a bottom portion of the column mechanism, the base member including lateral support members for providing forward support for the column mechanism and carriage assembly.

2. The adjustable carriage assembly of claim 1, wherein the operable connection between the shaft assembly and the lift pad assemblies includes a self-locking mechanism.

3. The adjustable carriage assembly of claim 1, wherein the synchronous movement includes lateral movement towards or away from the centerline of the carriage section.

4. The adjustable carriage assembly of claim 1, wherein the shaft assembly includes at least one leverage component at an end portion thereof, the leverage component being fixed on the shaft assembly non-rotatably with respect to the shaft assembly.

5. The adjustable carriage assembly of claim 4, wherein rotation of the leverage component causes the shaft assembly to translate the rotation into the synchronous movement of the lift pad assemblies.

6. A method of lifting a vehicle tire attached to a vehicle axle using a column mechanism slideably coupled to a carriage assembly having first and second lift pad assemblies comprising:

rotating a leverage component presenting a polygonal outer surface to thereby cause rotation of a threaded shaft, wherein rotation of the threaded shaft causes synchronous movement of synchronously moving the first and second lift pad assemblies towards a center of the carriage assembly;

engaging the vehicle tire at a first side of a circumference of the vehicle tire with the first lift pad assembly;

engaging the vehicle tire at a second side of a circumference of the vehicle tire with the second lift pad assembly; and substantially centering the vehicle tire with respect to the carriage assembly.

7. The method of claim 6, wherein the engaging with the first and second lift pad assemblies occurs substantially simultaneously.

8. A lift system for lifting a vehicle tire attached to a vehicle axle comprising:

a carriage assembly including a carriage section and a movement synchronizer, the carriage section having a centerline, a support assembly, a first lift pad assembly, a second lift pad assembly and a down stop assembly, the down stop assembly being shiftably coupled to the support assembly, the first and second lift pad assemblies being at least partly supported by and shiftable relative to the support assembly, the first and second lift pad assemblies being operably connected to the movement synchronizer on opposite sides of the centerline, the movement synchronizer being configured to cause synchronous movement of the lift pad assemblies when the movement synchronizer is activate;

a column to which the carriage assembly is coupled for vertical movement relative to the column, wherein the column comprises a plurality of vertically-spaced stops, wherein the down stop assembly is configured to shift into engagement with the stops as the carriage assembly moves vertically relative to the column; and a base member attached to a bottom portion of the column, the base member including lateral support members for providing forward support for the column and carriage assembly.

9. The adjustable carriage assembly of claim 8, wherein the down stop assembly is shiftable between an engaged configuration and a disengaged configuration, wherein when the down stop assembly is in the engaged configuration the down stop assembly engages the stops and prevents lowering of the carriage assembly relative to the column, wherein when the down stop assembly is in the disengaged configuration the down stop assembly does not engage the stops and permits lowering of the carriage relative to the column.

10. The adjustable carriage assembly of claim, 9 wherein the carriage assembly further comprises a maneuvering device for shifting the down stop assembly between the engaged and disengaged configuration.

11. The adjustable carriage assembly of claim 8, wherein the down stop assembly is configured to pivot relative to the support assembly.

12. The adjustable carriage assembly of claim 8, wherein the down stop assembly is located on one side of the centerline, wherein the carriage assembly comprises an additional down stop assembly located on the other side of the centerline.

13. The adjustable carriage assembly of claim 8, wherein the column presents a front face, wherein the support assembly comprises a connecting arm extending outwardly from the front face.

14. The adjustable carriage assembly of claim 13, wherein at least a portion of the stops are located on the front face.

15. The adjustable carriage assembly of claim 13, wherein the support assembly further comprises a top rail and a bottom rail, wherein the connecting arm is rigidly coupled to the top and/or bottom rail.

16. The adjustable carriage assembly of claim 15, wherein the down stop assembly is shiftably coupled to the top or bottom rail.

17. The adjustable carriage assembly of claim 15, wherein the down stop assembly is pivotably coupled to the top rail.

18. The adjustable carriage assembly of claim 8, wherein the movement synchronizer is selected from the group consisting of a rack and pinion, a four bar linkage, hydraulics, and a threaded shaft assembly.

19. The adjustable carriage assembly of claim 8, wherein the movement synchronizer comprises a rotatable threaded shaft.

20. The adjustable carriage assembly of claim 19, wherein the movement synchronizer further comprises a rotatable leverage component presenting a polygonal outer surface to which a wrench can be attached, wherein the leverage component and the threaded shaft are configured such that rotation of the leverage component causes rotation of the threaded shaft.

* * * * *

UNITED STATES PATENT AND TRADEMARK OFFICE

CERTIFICATE OF CORRECTION

PATENT NO. : 8,282,075 B2
APPLICATION NO. : 12/894695
DATED : October 9, 2012
INVENTOR(S) : Raymond C. Chan It is certified that error appears in the above-identified patent and that said Letters Patent is hereby corrected as shown below:

In the Claims:

Column 8, Line 12, remove “synchronously moving”.

Column 8, Line 59, replace “claim, 9” with “claim 9,”.

Signed and Sealed this
Sixteenth Day of July, 2013

Teresa Stanek Rea
*Acting Director of the United States Patent and Trademark Office*